United States Patent [19]

Ichikawa

[11] 4,236,237

[45] Nov. 25, 1980

[54] ELECTRONIC WRISTWATCH

[75] Inventor: Singo Ichikawa, Sayama, Japan

[73] Assignee: Citizen Watch Company Limited, Tokyo, Japan

[21] Appl. No.: 928,797

[22] Filed: Jul. 28, 1978

[30] Foreign Application Priority Data

Aug. 12, 1977 [JP] Japan ..... 52-107709[U]
Aug. 16, 1977 [JP] Japan ..... 52-109392[U]

[51] Int. Cl.[3] ..... G04B 9/00; G04C 23/00; G04C 9/00

[52] U.S. Cl. ..... 368/66; 368/187; 368/243

[58] Field of Search ..... 58/23 BA, 152 H, 85.5; 340/636, 661, 663; 324/29.5

[56] References Cited

U.S. PATENT DOCUMENTS

| | | | |
|---|---|---|---|
| 3,898,790 | 8/1975 | Takamune et al. | 58/23 BA |
| 3,911,360 | 10/1975 | Kimzey | 340/663 |
| 3,949,545 | 4/1976 | Chihara | 58/152 H |
| 4,004,407 | 1/1977 | Fujita | 58/85.5 |
| 4,028,880 | 6/1977 | Ueda | 58/23 BA |
| 4,175,377 | 11/1979 | Ichikawa | 58/23 BA |

*Primary Examiner*—Vit W. Miska
*Attorney, Agent, or Firm*—Holman & Stern

[57] ABSTRACT

In an electronic wristwatch having a digital type of photo-electric display and powered by a battery, a battery life warning system is provided whereby the battery voltage is checked at periodic intervals and the photoelectric display is caused to flash on and off repetitively to indicate the approach of the end of the battery life. The timing of sampling pulses applied to a voltage detection circuit is controlled such that a temporary drop in battery voltage does not cause a display warning signal to be generated.

12 Claims, 2 Drawing Figures

TIMEKEEPING COUNTER CIRCUIT 16
18
20
22
24
Ps
Pr
DECODER
26
DISPLAY CONTROL CIRCUIT
28
DRIVER
29
DISPLAY 30
32
33
34
35
TUE
FREQUENCY DIVIDER
14
OSCILLATOR
12
10
46
48
44
Q
R
S
O
42
VOLTAGE DETECTION CIRCUIT
11
PC
Cd
Cc
Cb
Ca
ND
CORRECTION SIGNAL CONTROL CIRCUIT
36
40
38
VDD
ERROR OPERATION DETECTION CIRCUIT 45

TIMEKEEPING COUNTER CIRCUIT 16
24
22
20
18
P1
P2
FREQUENCY DIVIDER
14
OSCILLATOR
12
10
DECODER
26
DISPLAY CONTROL CIRCUIT
28
DRIVER
29
DISPLAY 30
32
33
34
35
TUE
46
42
C
O
S
Ps
VOLTAGE DETECTION CIRCUIT
52
PC
Cd
Cc
Cb
Ca
ND
CORRECTION SIGNAL CONTROL CIRCUIT
36
40
38
VDD
ERROR OPERATION DETECTION CIRCUIT 51
11

ELECTRONIC WRISTWATCH

At present, electronic timepieces powered by a battery have come into common use. Many of such timepieces employ a photo-electric display to indicate time information in a digital manner. Such timepieces generally incorporate means whereby each digit of the time information can be selected for correction and then corrected by, for example, actuation of an external control member for a required number of times. Indication that a particular digit has been selected for correction can be given by causing the selected digit to flash on and off rapidly. In such an electronic timepiece, it is extremely desirable to provide means for indicating to the user that the end of the battery life is imminent, since when the battery voltage falls below a certain level, the timekeeping functions of the timepiece will begin to be affected. It is therefore necessary for the timepiece user to change over the battery before the voltage falls below such a level. Various methods have heretofore been proposed for providing a warning to the timepiece use that the battery is approaching the end of its life. Such a system can be based, for example, upon periodically sampling the battery voltage and comparing it with the threshold voltage of a field effect transistor. If the battery voltage is found to have fallen below a predetermined level then a visible or audible warning signal is given to the timepiece user.

It is however possible for the battery voltage to temporarily fall below the predetermined level due to an unfavorable operating condition. This can occur, for example, if the ambient temperature is extremely low so that the internal resistance of the battery is increased thereby causing a drop in battery voltage. Such a case can also apply if the timepiece is used for a long time under a condition of very low ambient light, so that a lamp incorporated in the timepiece to illuminate the display is used for a long time. With the battery life warning systems which have been proposed heretofore, such a temporary drop in battery voltage due to unfavorable operating conditions will be detected by the battery life warning system and a warning signal will be given to the timepiece user. This can cause unnecessary anxiety in the user and can result in the battery being changed over before this is really necessary.

With the method of the present invention for a battery life warning system, only a drop in battery voltage which continues for a substantial period of time, for example more than 24 hours, will result in a battery life warning signal being issued. Thus, any temporary drop in battery voltage due to some unfavorable operating condition will not result in a warning signal. In addition, the warning can be provided by causing the entire timepiece display to rapidly flash on and off. The same control system used to cause display flashing of a time digit which has been selected for correction can be used to provide the battery life warning signal. Thus, the method of the present invention can easily be applied to an existing design of electronic timepiece having an opto-electronic display.

It is therefore an object of the present invention to provide an improved battery life warning system for an electronic timepiece.

More particularly, it is an object of the present invention to provide an improved battery life warning system for an electronic timepiece whereby any temporary drop in battery voltage due to an unfavorable operating condition will not cause a display warning to be generated.

These and other objects, features and advantages of the present invention will be made more apparent by the following description and the attached figures wherein.

Figure 1:
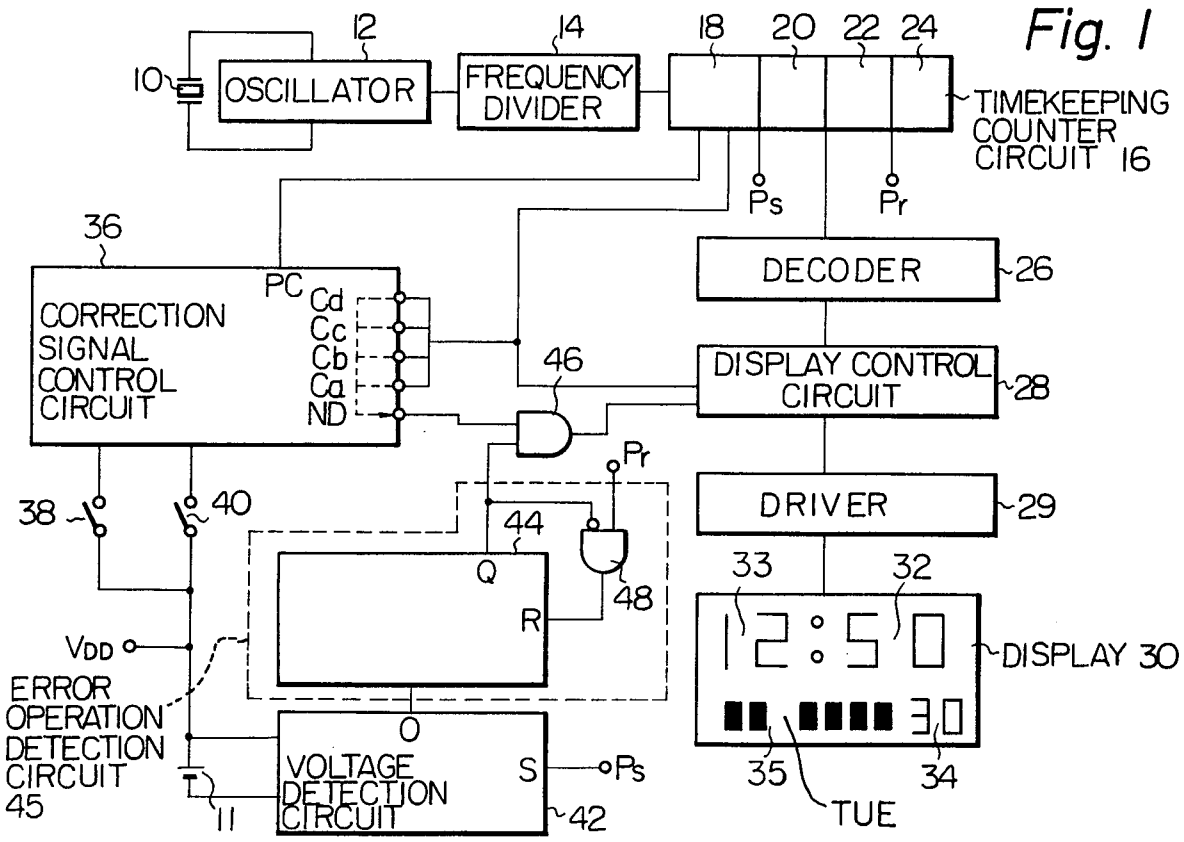
FIG. 1 is a block wiring diagram of a first embodiment of the present invention, whereby an error operation detection circuit is reset once in every 24 hours.

Referring now to FIG. 1 a block wiring diagram of a first embodiment of the present invention is shown therein. Numeral 10 indicates a quartz crystal vibrator element which is connected to control the frequency of an oscillator 12. The output from oscillator 12 is applied to a frequency divider 14, which produces a standard timekeeping signal with a frequency of 1 Hz. This is applied to a timekeeping counter circuit comprising a minutes counter 18, an hours counter 20, a days-of-the-month counter 22 and a weekday counter 24. Output signals from timekeeping counter circuit 16 are applied to a decoder 26. Output signals from decoder 26 are applied to display control circuit 28. The output from display control circuit 28 is applied to driver circuit 29 which supplies drive signals to operate a photo-electric digital type display 30. Display 30 contains a minutes display 32 an hours display 33, a days-of-the-month display 34 and a weekday display 35 corresponding to minutes counter 18, hours counter 20, a days-of-the-month counter 22 and a weekdays counter 24, respectively. Sampling pulses Ps with a period of two hours and sampling pulses Pr with a period of 24 hours are produced by timekeeping counter circuit 16. Numeral 36 indicates a correction signal control circuit. In the normal timekeeping mode, the normal display terminal ND is at the H logic level. Successive actuation of a digit selector switch 38 causes minutes correction terminal Ca to go to the H level causing the minutes counter 18 to be selected for correction and at the same time causing the minutes display 32 on display 30 to flash on and off rapidly, through the action of display control circuit 28. The minutes counter contents can now be corrected by successive actuations of a digit correction switch 40. When correction of the minutes has been completed, a second actuation of digit selector switch 38 will cause hours correction terminal Cb to go to the H level. As a result, the hours counter 20 will be selected for correction and display control circuit 28 will cause the hours display section 33 of display 30 to flash on and off thereby indicating that hours correction has been selected.

When correction of the hours has been completed, digit selector switch 38 is again actuated, causing days-of-the-month correction terminal Cc to go to H level. Correction of the day of the month has now been selected, and the days of the month display section 34 on display 30 is caused to flash on and off rapidly by display control circuit 28 to indicate that the days of the month have been selected. Correction can now be performed by actuation of digit correction switch 40. When correction of the days of the month is completed, a forth actuation of digit selector switch 38 causes weekdays correction terminal Cd to go to the H level. Correction of the weekdays can now be performed by actuation of digit correction switch 40. At this time, the weekdays section 35 of display 30 is caused to flash on and off as an indication of selection. When correction of the weekdays has been completed, a further actuation of digit selector switch 38 will cause the normal display terminal Nd of correction signal control circuit 36 to go to the H level once more. Correction signals generated by actuation of digit correction switch 40 are applied to timekeeping counter circuit 16 from correction signal terminal PC of correction signal control circuit 36. Battery voltage detection circuit 42 serves to compare the voltage of battery 11, which serves as the timepiece power source, with the threshold voltage of a field effect transistor. This comparison is performed each time one of sampling pulses Ps is produced, i.e. once every two hours. If the battery voltage is above a predetermined minimum level when a Ps sampling pulse occurs, then output O of voltage detection circuit 42 remains at the L level. If the voltage of battery 11 is below the predetermined minimum level when a sampling pulse Ps is applied, then output O of voltage detection circuit 42 goes to the H level momentarily. Numeral 45 indicates an error operation detection circuit which comprises a counter 44 and AND gate 48. Output Q of counter 44 is normally at the L level, but goes to the H level when three input pulses have been applied. Each time an H level signal is produced from terminal O of voltage detection circuit 42, then counter 44 is incremented. Normally, output Q of counter 44 is at the L level so that AND gate 46 is inhibited, while an H level input is applied to AND gate 48 through an inverting input terminal. A reset signal pulse Pr is applied to AND gate 48 once every 24 hours, so that counter 44 is reset if output Q is at the L level when a reset pulse Pr is produced. When three successive H level input signals have been applied to counter 44 from terminal O of voltage detection circuit 42, then output Q of counter 44 goes to the H level. As a result, AND gate 46 is enabled. If the timepiece is now in the normal timekeeping mode of operation, i.e. digit correction has not been selected, then output ND of correction signal control circuit 36 is at the H level. Thus, an H level output is applied from AND gate 46 to display control circuit 28. This causes display control circuit 28 to produce an output signal whereby all of the display sections of display 30 begin to rapidly flash on and off. This serves as a warning signal to the timepiece user that the end of battery life is approaching.

Thus, if a temporary drop in battery voltage occurs due to some unfavorable conditions such as an excessively low ambient operating temperature or to the display illumination lamp being actuated for a long period of time in conditions of low ambient light, then since sampling pulses Ps are applied only once every two hours, it is virtually certain that less than three H level signals will be applied to counter 44 from voltage detection circuit 42 within a 24-hour period. If less than three input pulses are applied to counter 44 from terminal O of voltage detection circuit 42 within 24 hours, then output Q of counter circuit 44 will not rise above the L level.

If, however, the battery voltage falls below the predetermined minimum level due to the battery approaching the end of its life, then the battery voltage will remain be low the minimum level for an extended period of time. Thus, more than three H level pulses will be input to counter 44 from the terminal O of voltage detection circuit 42 within 24 hours. An H level output will therefore be produced from terminal Q of counter 44, enabling AND gate 46 so that a battery life warning signal will be produced by simultaneous flashing of all display sections of display 30 as described above. At the same time AND gate 48 is inhibited so that subsequent reset pulses PR will not reset counter 44.

If, the timepiece user wishes to perform digit correction after a battery life warning signal has started to be produced, this can be done. Actuation of a digit selector switch 38 causes normal display terminal ND of correction signal control circuit 36 to go to the L level. As a result AND gate 46 is inhibited so that its output falls to the L level. Only the display digits which have been selected for correction are now caused to flash on and off, as an indication of selection. When the timepiece is returned to the normal timekeeping mode however, by further actuation of digit selector switch 38, terminal ND again goes to the H level so that AND gate 46 is again enabled and flashing of all sections of display 30 again begins. In this way, even if a battery life warning has begun to be produced, it is still possible for the timepiece user to perform correction of the timekeeping counter circuits.

Figure 2:
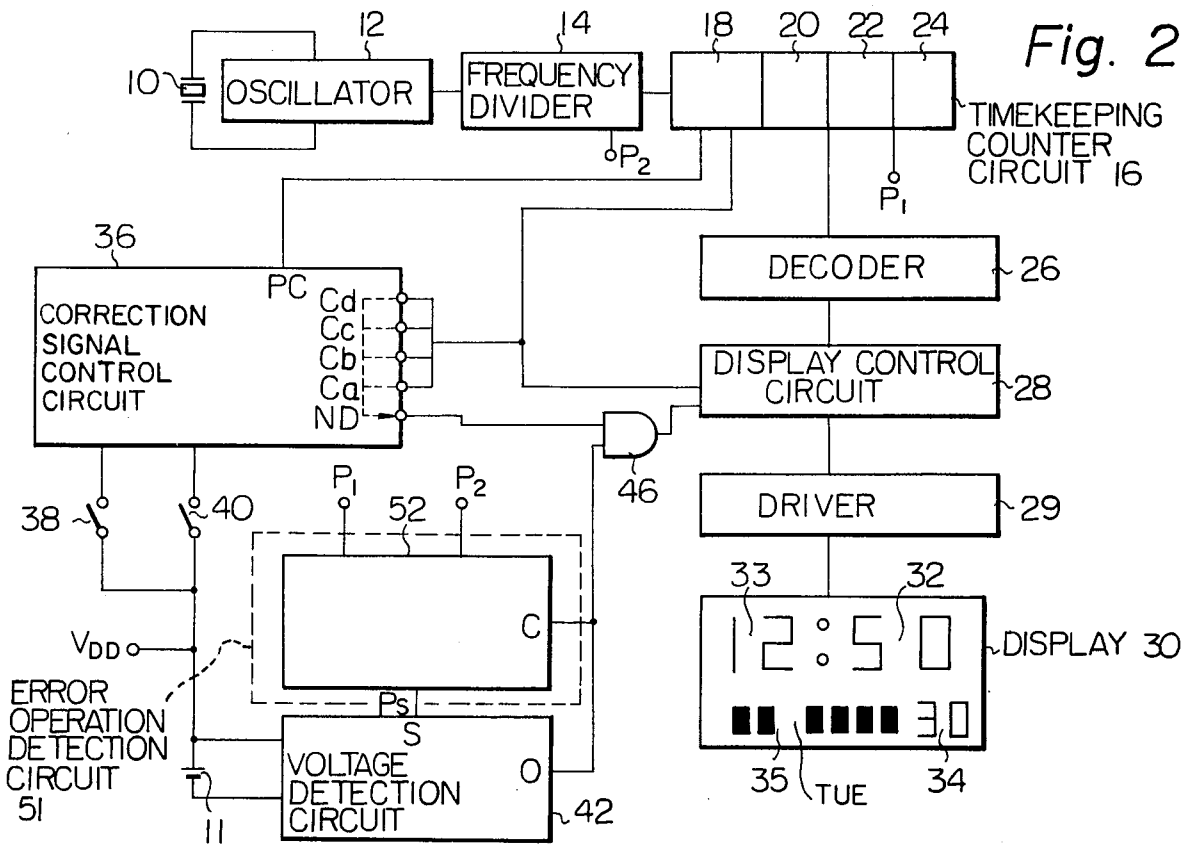
FIG. 2 is a block wiring diagram of a second embodiment of the present invention whereby one of two different battery voltage sampling signals is selected in accordance with an output signal of a battery voltage detection circuit.

A second embodiment of the present invention will now be described with reference to FIG. 2. In FIG. 2, blocks and components having the same function as in the first embodiment shown in FIG. 1 and described above, are indicated by the same numerals as in FIG. 1. Sampling signal P2, which has a period of 10 seconds, is produced by frequency divider circuit 14. Sampling signal P1, which has a period of 24 hours, is produced by timekeeping counter circuit 16. Correction signal control circuit 36 has the same functions as described for the first embodiment above. Numeral 51 indicates an error operation detection circuit, which comprises a changeover circuit 52. This functions to select either P1 or P2 to be applied as sampling signal Ps to terminal S of voltage detection circuit 42. This selection function is controlled by the level of a control signal applied to terminal C of changeover circuit 52 from terminal O of voltage detection circuit 42. If the voltage of battery 11 is above a certain predetermined minimum level, then the output signal from terminal O of voltage detection circuit 42 is at the L logic level. If, however, the battery voltage falls below this minimum level for some reason, then the output signal from terminal O of voltage detection circuit 42 will go to the H level. When the signal from terminal O is at the L logic level, then signal P1 is selected to be applied to voltage detection circuit as sampling signal Ps. In this case, therefore, sampling is performed by the voltage detection circuit once in every 24 hours. If the voltage of battery 11 should be below the minimum predetermined voltage level when sampling pulse Ps is applied, then the output signal from terminal O of voltage detection circuit 42 will go to the H level. This will cause signal P2 to be selected for application to voltage detection circuit as sampling signal Ps. Sampling will then begin to be performed by voltage detection circuit 42 once every 10 seconds.

If the drop in battery voltage is only a temporary phenomenon, due for example to the timepiece display illumination lamp being actuated when the ambient temperature is excessively low, then after the battery voltage recovers, the output signal from terminal O of voltage detection circuit 42 will return to the L level within a maximum of 10 seconds, i.e. as soon as the next Ps sampling pulse is applied after the battery voltage rises above the predetermined level. Thus, the timepiece user is notified that there has been a temporary drop in the battery voltage, but that this is not due to the battery having reached the end of its life.

As for the first embodiment of the present invention described above, an H level signal is applied to an input of AND gate 46 when the battery voltage falls below the predetermined level. In the case of the second embodiment, this H level signal is applied from the O terminal of voltage detection circuit 42. If the timepiece is in the normal timekeeping mode of operation at this time, then an H level output will be delivered to display control circuit 28 from AND gate 46, causing all display sections of display 30 to flash on and off consecutively, thereby providing a battery life warning signal to the user. Thus, if there is only a temporary drop in the battery voltage, then only temporary display flashing will occur. If, however, the battery voltage has dropped below the predetermined level due to the battery having almost reached the end of its life, then the O terminal of voltage detection circuit 42 will remain continuously at the H logic level due to the action of sampling pulses Ps with a period of 10 seconds. If this case, so long as terminal ND of correction signal control circuit 36 is at the H level, i.e. the timepiece is not in the digit correction mode of operation, then an H level output will be applied continuously from AND gate 46 to display control circuit 28. All display sections of display 30 will therefore be caused to flash on and off continuously, thereby notifying the timepiece user that the battery is approaching the end of its life.

With the method of the second embodiment of the present invention, therefore, a battery life warning signal is produced only if the battery voltage is below the predetermined level when a P2 signal pulse is applied as a sampling pulse to voltage detection circuit 42. These sampling pulses are produced only once on 24 hours, so that the power consumed by the sampling operation is extremely low. If a temporary drop in the battery voltage occurs, then sampling pulses at a rate of one every 10 seconds are applied to voltage detection circuit 42. However when the battery voltage recovers to rise above the predetermined level, changeover circuit 52 changes over to select signal P1 as the sampling pulses, i.e. the period of sampling pulses Ps reverts to 24 hours.

Although sampling signal periods of 24 hours and 10 seconds are utilized in the embodiment of the present invention described above, it is possible to utilize other frequencies of sampling signals without departing from the scope of the present invention. Also, although a battery life warning signal consisting of the entire display flashing on and off is utilized in the first and second embodiments of the present invention, it is also possible to utilize other signal means such as a buzzer being sounded periodically, etc. Such a case will also come under the scope of the present invention.

It will now be appreciated from the foregoing description that in accordance with the present invention a battery warning system comprises a voltage detection circuit for detecting a drop in voltage of a battery below a predetermined level to produce a detection signal, means for providing the warning of a life of the battery in response to the detection signal, and error operation detection circuit means for detecting the detection signal being produced due to a temporary drop in voltage below the predetermined level and compensating the detection signal to disenable the warning providing means, whereby unfavorable warning due to temporary drop in battery voltage is avoided.

While the present invention has been shown and described with reference to particular embodiments, it should be noted that various other changes or modifications may be made without departing from the scope of the present invention.

What is claimed is:

1. A battery warning system for an electronic timepiece powered by a battery, comprising:

a voltage detection circuit coupled to said battery for detecting a drop in voltage of said battery below a predetermined level to produce a detection signal indicative thereof;

means for providing the warning of a life of said battery in response to said detection signal; and error operation detection circuit means comprising a counter circuit means for counting said detection signal and producing a control signal to enable said warning providing means when a count of said detection signal reaches a predetermined count value within a predetermined time interval, and reset pulse generating means for resetting said counter circuit means when the count of said detection signal is less than said predetermined count value within said predetermined time interval.

2. A battery warning system according to claim 1, further comprising means for generating sampling pulses for rendering said voltage detection circuit operative at predetermined time instants.

3. A battery warning system according to claim 2, in which said voltage detection circuit produces detection signal pulses as said detection signal in response to said sampling pulses.

4. A battery warning system for an electronic timepiece powered by a battery, comprising:

a voltage detection circuit coupled to said battery for detecting a drop in voltage of said battery below a predetermined level to produce a detection signal indicative thereof;

means for providing the warning of a life of said battery in response to said detection signal;

means for generating first and second sampling pulses being different in frequency from one another; and error operation detection circuit means comprising a changeover circuit means responsive to said detection signal and selectively applying one of said first and second sampling pulses to said voltage detection circuit.

5. A battery warning system according to claim 4; in which said first sampling pulses have a low frequency and said second sampling pulses have a high frequency, and in which said changeover circuit passes said first sampling pulses to said voltage detection circuit, in the absence of said detection signal, which is consequently sampled at a long period of time, and passes said second sampling pulses to said voltage detection circuit, in the presence of said detection signal, which is consequently sampled at a short period of time.

6. An electronic timepiece powered by a battery, comprising:

a source of a standard frequency timing signal;

timekeeping circuit means responsive to said standard frequency timing signal for counting time information;

digital time display means;

display control circuit means adapted to control said digital time display means;

a battery life warning system including voltage detection circuit means responsive to a first sampling signal generated by said timekeeping circuit means for detecting a drop in voltage of said battery below a predetermined level and for generating a detection signal pulse when such a drop in voltage is detected;

counter circuit means for counting said detection signal and producing a control signal when a count of said detection signal pulses reaches a predetermined count value within a predetermined time interval, said control signal being applied to said display control circuit means to thereby cause visible modulation of said digital time display means; and gate circuit means responsive to a second sampling signal generated by said timekeeping circuit means for resetting said counter circuit means when the count of said detection signal is less than said predetermined count value within said predetermined time interval.

7. An electronic timepiece according to claim 6, further comprising:

first and second external operating members;

correction signal control circuit means coupled to said timekeeping circuit means and said display circuit means responsive to actuation of said first external operating member for selection of time digits of said digital time display means and responsive to actuation of said second external operating member for correcting said selected time digits; and gate circuit means coupled between said correction signal control circuit means and said display control circuit means and responsive to actuation of said first external operating member for inhibiting said control signal when time digits of said digital time display means have been selected for correction.

8. An electronic timepiece powered by a battery, comprising:

a source of a standard frequency timing signal;

timekeeping circuit means responsive to said standard frequency timing signal for counting time information;

digital time display means;

display control circuit means adapted to control said digital time display means;

a battery life warning system including changeover circuit means for selecting one of a first sampling pulse signal and a second sampling pulse signal responsive to a detection signal; and voltage detection circuit means responsive to one of said first sampling pulse signal and said second sampling pulse signal selected by said changeover circuit means for detecting the voltage of said battery and for generating said detection signal if said battery voltage is below a predetermined level, said detection signal being applied to said display control circuit means to thereby cause visible modulation of said digital time display means.

9. An electonic timepiece according to claim 8, in which said first sampling pulse signal has a low frequency and said second sampling pulse signal has a high frequency, and in which said changeover circuit passes said first sampling pulse signal to said voltage detection circuit, in the absence of said detection signal, which is consequently sampled at a long period of time, and passes said second sampling pulse signal to said voltage detection circuit, in the presence of said detection signal, which is consequently sampled at a short period of time.

10. An electronic timepiece according to claim 9, further comprising:

first and second external operating members;

correction signal control circuit means coupled to said timekeeping circuit means and said display circuit means responsive to actuation of said first external operating member for selection of time digits of said digital time display means and responsive to actuation of said second external operating member for correcting said selected time digits; and gate circuit means coupled between said correction signal control circuit means and said display control circuit means and responsive to actuation of said first external operating member for inhibiting said detection signal from being appled to said display control circuit means when time digits of said digital time display means have been selected for correction.

11. An electronic timepiece powered by a battery, comprising:

a source of a standard frequency timing signal;

timekeeping circuit means responsive to said standard frequency timing signal for counting information;

digital time display means;

display control circuit means adapted to control said digital time display means;

a battery life warning system including voltage detection circuit means responsive to a first sampling signal generated by said timekeeping circuit means for detecting a drop in voltage of said battery below a predetermined level and for generating a detection signal when such a drop in voltage is detected;

counter circuit means for counting said detection signal pulse and producing a control signal when a count of said detection signal pulses reaches a predetermined count value within a predetermined time interval, said control signal being applied to said display control circuit means to thereby cause visible modulation of said digital time display means;

gate circuit means responsive to a second sampling signal generated by said timekeeping circuit means for resetting said counter circuit means when the count of said detection signal pulses is less than said predetermined count value within said predetermined time interval;

first and second external operating members;

correction signal control circuit means coupled to said timekeeping circuit means and said display control circuit means responsive to actuation of said first external operating member for selection of time digits of said digital time display means and responsive to actuation of said second external operating member for correcting said selected time digits; and gate circuit means coupled between said correction signal control circuit means and said display control circuit means and responsive to actuation of said first external operating member for inhibiting said control signal when time digits of said digital time display means have been selected for correction.

12. An electronic timepiece powered by a battery, comprising:

a source of a standard frequency timing signal and a second sampling pulse signal;

timekeeping circuit means responsive to said standard frequency timing signal for counting time information and producing a first sampling pulse signal;

digital time display means;

display control circuit means adapted to control said digital time display means;

a battery life warning system including changeover circuit means for selecting one of said first and second sampling pulse signals responsive to a detection signal;

voltage detection circuit means responsive to one of said first and second sampling pulse signals selected by said changeover circuit means for detecting the voltage of said battery and for generating said detection signal if said battery voltage is below a predetermined level, said detection signal being applied to said display control circuit means to thereby cause visible modulation of said digital time display means;

first and second external operating members;

correction signal control circuit means coupled to said timekeeping circuit means and said display control circuit means responsive to actuation of said first external operating member for selection of said digital time display means and responsive to actuation of said second external operating member for correcting said selected time digits; and gate circuit means coupled between said correction signal control circuit means and said display control circuit means and responsive to actuation of said first external operating member for inhibiting said detection signal from being applied to said display control circuit means when time digits of said digital time display means have been selected for correction.

* * * * *